US006415541B1

(12) United States Patent
Rassias

(10) Patent No.: US 6,415,541 B1
(45) **Date of Patent: *Jul. 9, 2002**

(54) SECURITY AND DEPLOYMENT ASSEMBLY

(76) Inventor: John N. Rassias, 7700 Cedarwood Cir., Boca Raton, FL (US) 33434

( * ) Notice: Subject to any disclaimer, the term of this patent is extended or adjusted under 35 U.S.C. 154(b) by 0 days.

This patent is subject to a terminal disclaimer.

(21) Appl. No.: 09/508,952

(22) PCT Filed: Oct. 2, 1998

(86) PCT No.: PCT/US98/20877

§ 371 (c)(1),
(2), (4) Date: Mar. 17, 2000

(87) PCT Pub. No.: WO99/18407

PCT Pub. Date: Apr. 15, 1999

Related U.S. Application Data

(60) Provisional application No. 60/061,085, filed on Oct. 3, 1997.

(51) Int. Cl.[7] ..... F41A 17/00
(52) U.S. Cl. ..... 42/70.11
(58) Field of Search ..... 42/70.11, 44, 70.07; 224/911, 193, 192, 238

(56) References Cited

U.S. PATENT DOCUMENTS

| | | | | | |
|---|---|---|---|---|---|
| 835,349 | A | | 11/1906 | Deming | |
| 2,997,802 | A | * | 8/1961 | Robbins | 42/70.11 |
| 4,218,000 | A | * | 8/1980 | Mixson | 224/193 |
| 4,485,948 | A | * | 12/1984 | Cook | 224/243 |
| 4,858,799 | A | | 8/1989 | Young | 224/243 |
| 4,912,867 | A | * | 4/1990 | Dukes, Jr. | 42/70.11 |
| 4,961,277 | A | | 10/1990 | Rosenbaum | 42/70.11 |
| 5,044,106 | A | | 9/1991 | Slocum | 42/70.11 |
| 5,099,596 | A | | 3/1992 | Butler, Jr. | 42/70.11 |
| 5,284,281 | A | * | 2/1994 | Nichols | 224/244 |
| 5,419,069 | A | * | 5/1995 | Mumbleau et al. | 42/70.11 |
| 5,441,187 | A | * | 8/1995 | Mixson | 224/243 |
| 5,467,909 | A | * | 11/1995 | Resca et al. | 224/193 |
| 5,611,164 | A | | 3/1997 | Rassias | 42/70.11 |
| 5,732,498 | A | * | 3/1998 | Arreguin | 42/70.11 |
| 5,768,816 | A | * | 6/1998 | Rassias | 42/70.11 |

* cited by examiner

*Primary Examiner*—Charles T. Jordan
*Assistant Examiner*—John W. Zerr
(74) *Attorney, Agent, or Firm*—Webb Ziesenheim Logsdon Orkin & Hanson, P.C.

(57) ABSTRACT

Several improvements to a locking assembly for a firearm are disclosed. The locking assembly may be provided with means for adjusting a mounting position of an action locking arm (18) and lug within the locking assembly. A retention loop (34) may be attached to a slide shield (10) on the locking assembly, which retention loop (34) may be removably secured behind a firearm to retain the firearm in the slide shield (10) when the firing chamber is closed. The locking assembly may be provided with an enclosing holster (70) which receives the slide shield (10) and the firearm. The enclosing holster (70) may have a hinged flap with means for securing the flap in a closed position. Finally, a locking pin may be provided, which is insertable in a slide lock (30) of the slide shield (10) to prevent passage of the firearm's barrel through the slide block. The locking pin (90) may have at one end a grip means an at an opposite end at least one compressible ball bearing.

5 Claims, 7 Drawing Sheets

SECURITY AND DEPLOYMENT ASSEMBLY

This application is a 371 of PCT/US98/20877, filed Oct. 2, 1998 which claims benefit to U.S. provisional application Ser. No. 60/061,085, filed Oct. 3, 1997.

BACKGROUND OF THE INVENTION

1. Field of the Invention

The invention relates to a locking assembly for portable firearms such as semiautomatic pistols or automatic machine pistols and, more particularly, to a locking assembly which safely houses the firearm in either a loaded or unloaded status and provides for drawing and automatically loading and cocking the firearm with only the action of the user's shooting hand.

2. Discussion of Prior Art

Locking assemblies for portable firearms are already known from U.S. Pat. No. 5,611,164. Such an assembly includes a body plate designed to center around the wearer's hip with openings to accommodate a belt for wearing, and an action locking assembly, which is attached to the body plate and exactly dimensioned for the specific pistol to be secured.

The action locking assembly includes a flat support member, and an action locking arm extending from a first upper end of the support member and a retainer arm extending from a second lower end of the support member. The action locking arm carries an action locking lug. This locking lug is received in the firing chamber and barrel face of a firearm and prevents cartridges from entering the firing chamber. When the firearm is removed from the locking assembly, the firearm is automatically loaded and cocked, ready to shoot.

A drawback of such locking assemblies is that they are made for firearms of only one length. Another drawback is that once the firearm is pulled, it has to be unloaded before it can be put back into the locking assembly. This can create problems when the user must attend to other matters before the firearm can be returned to the locking assembly.

The user may want to lock the firearm such that it can only be taken out of the assembly with a key. However, when suddenly the firearm is needed, it takes too long to unlock the firearm.

It is an object of the present invention to eliminate the above-mentioned drawbacks.

SUMMARY OF THE INVENTION

This object is reached by several improvements, according to the present invention, as follows. First, several mounting positions are provided for the action locking arm. Thus, firearms of different lengths can be locked in the locking assembly.

Second, an elastic band or "retention loop" is provided on the locking assembly in order to suspend the firearm in a loaded position within the locking assembly.

Third, for carrying the gun locked in the assembly, while still being able to remove it quickly from the assembly, the present invention provides a locking pin which has a compressible ball bearing at one end and a finger ring at the other.

Fourth, the present invention provides an enclosing holster to protect the firearm against environmental influences.

Fifth, the present invention provides several slots in the body plate in order to accommodate belts of different widths.

Finally, a spacer is interposed between the body plate and the locking assembly to facilitate mounting the enclosing holster and to enable carrying large firearms comfortably.

These and other advantages of the present invention will become more apparent from the following description, taken in conjunction with the accompanying drawings wherein like reference numerals represent like parts.

DETAILED DESCRIPTION OF THE PREFERRED EMBODIMENTS

Figure 1:
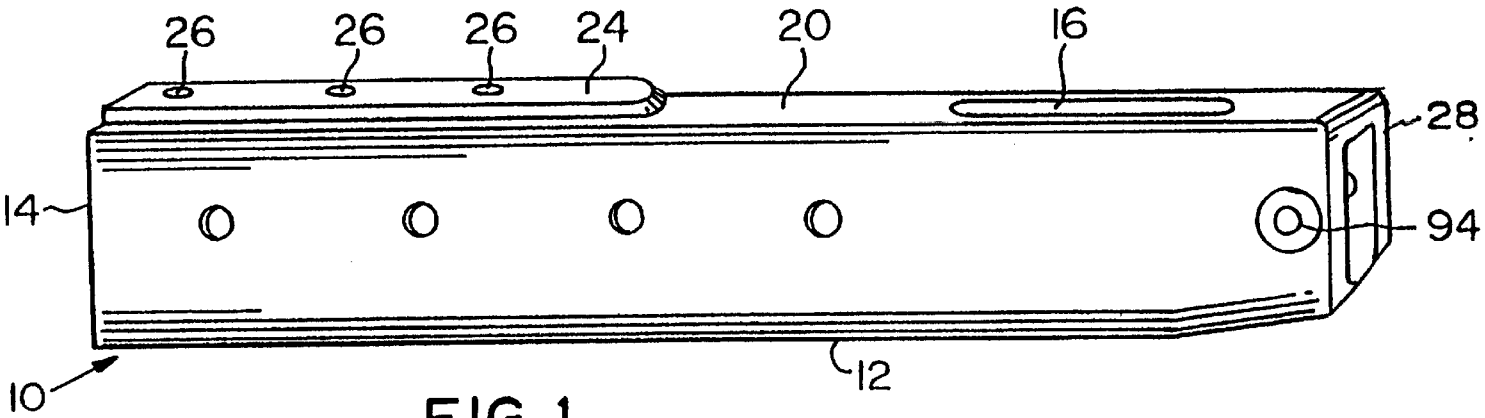
FIG. 1 shows a perspective side view of a locking assembly having an adjustable locking arm according to the present invention.
Figure 2:
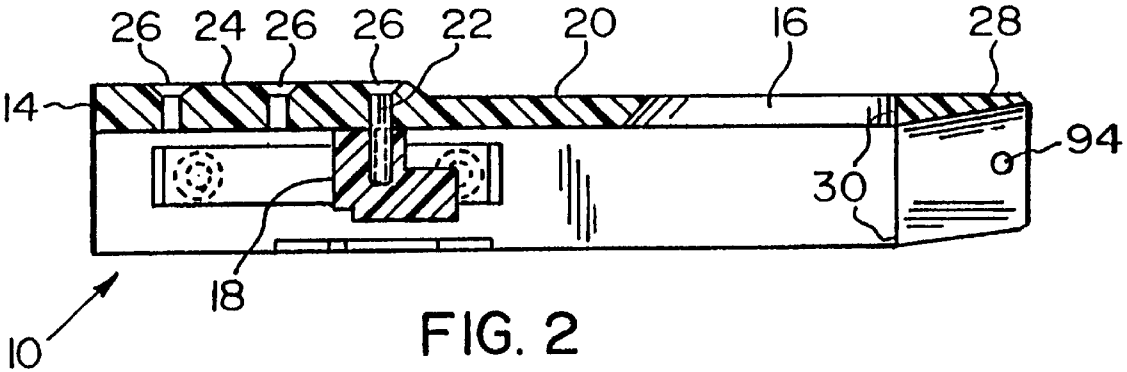
FIG. 2 shows a sectional view of the locking assembly of FIG. 1.

FIGS. 1 and 2 show a slide shield 10 of a locking assembly for portable firearms. Shield 10 has an opening 12 on the bottom and a first end 14, which is also open. Shield 10 has a sight slot 16 to provide clearance for the forward sight of a firearm. Further details respecting the slide shield 10 may be seen in U.S. patent application Ser. No. 08/743,797, filed Nov. 5, 1996, incorporated herein by reference.

Action locking arm 18 is secured to a top wall 20 by a bolt 22. Mounting plate 24 allows for removability of the action locking arm 18. It may be desired to replace arm 18 with another arm more suitable for a different pistol model, or to move the action locking arm 18 to accommodate firearms with different length slides. Holes 26 are provided for this purpose.

The second end 28 of the slide shield 10 has an integral slide block 30 which provides a bearing surface for the slide of a firearm.

Figure 3:
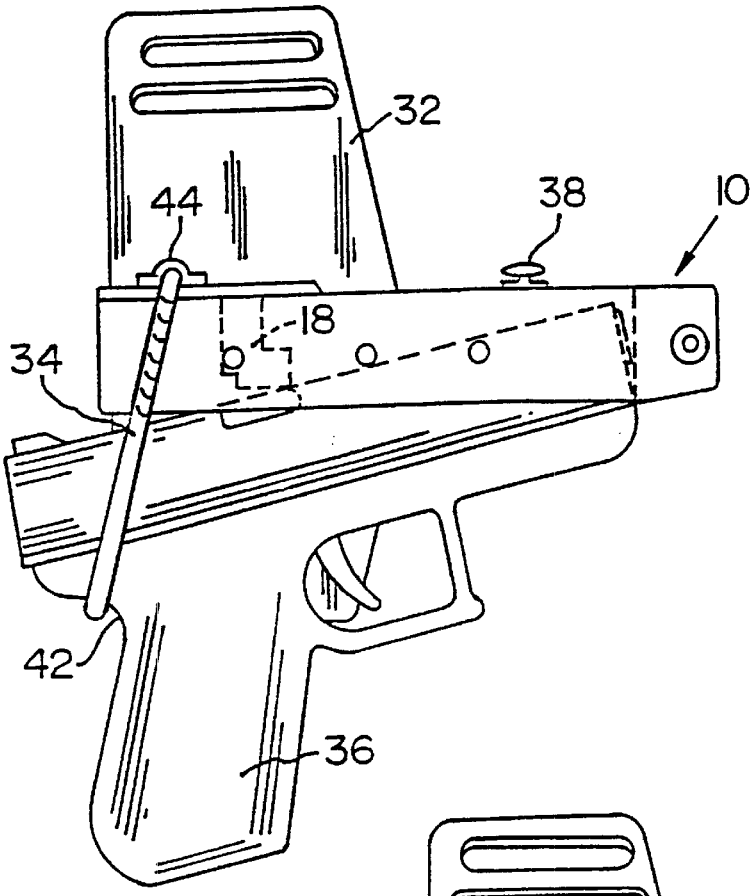
FIG. 3 shows a firearm suspended in a locking assembly with an elastic band according to the present invention.

FIG. 3 shows a further embodiment of the locking assembly according to the present invention, including a slide shield 10 mounted to a body plate 32 and a rubber retention loop 34.

The function of this rubber loop 34 is to allow, for example, an officer to re-holster his already loaded and cocked pistol momentarily in a secure manner while he attends to other requirements. Once the situation has stabilized, the pistol may be returned to the holster with an empty chamber and with no magazine within its grip while holstering. A loaded magazine is inserted into the grip of the pistol after the pistol's action is locked.

Figure 4A:
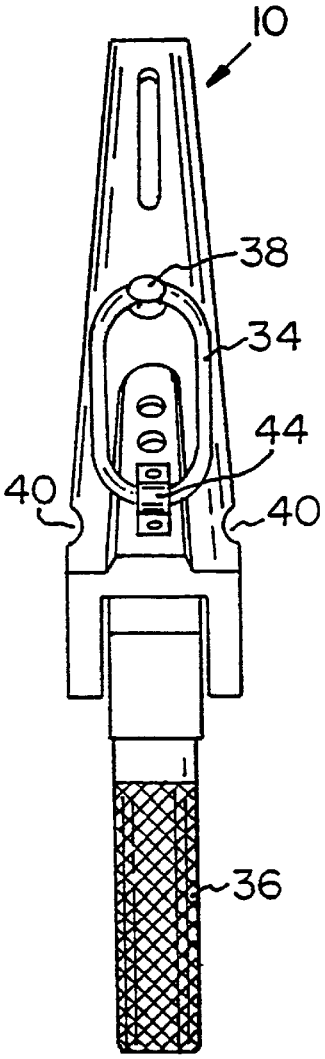
FIGS. 4 A, B and C show, respectively, a firearm brought into the locking assembly, the firearm suspended by an elastic band in the locking assembly, and the firearm being released out of the locking assembly according to the present invention.
Figure 4B:
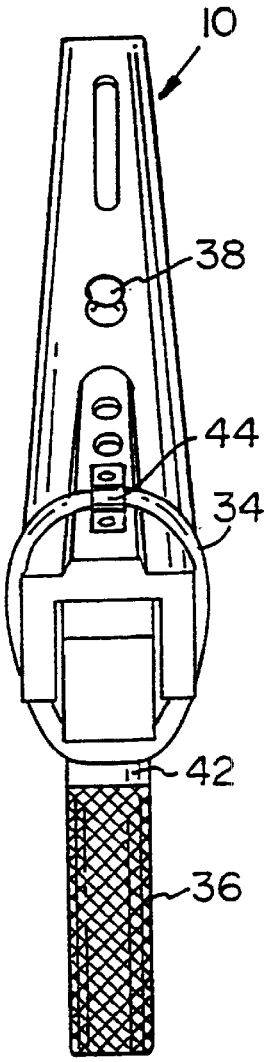
Figure 4C:
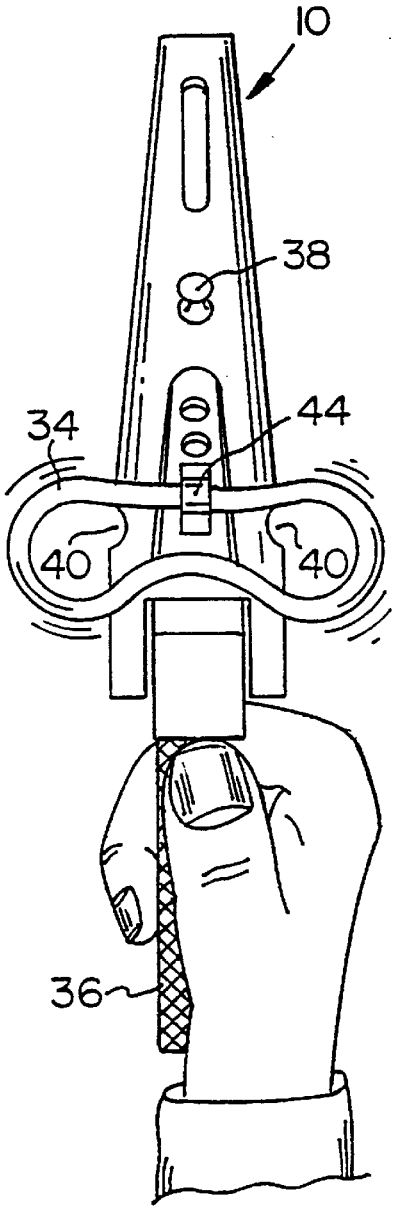

FIGS. 4A–4C show the use of rubber retention loop 34. This loop 34 is retained in a stowed mode by a retention loop post 38. A machined groove 40 is provided at an angle on the slide shield 10 to align the retention loop 34 when it is under compression against the back strap 42 of the hand gun grip. Retention loop restraining bracket 44 is so dimensioned as to allow the retention loop 34 to rotate freely within its diameter.

In FIG. 4A, the rubber retention loop 34 is secured by the post 38 on one end, with its other end secured by bracket 44. This is the stowed position of the retention loop.

In FIG. 4B, the rubber retention loop has been manually rolled off the post 38 at which point the retention loop 34 is extended over the top of the slide shield 10 whereby the retention loop 34 is positioned into the machined grooves 40 on either side of the slide shield. The top end of the loop is extended back over the handgun's slide and into the crotch of the back strap 42 of the handgun's grip. The expanded tension of the retention loop exerts sufficient pressure to keep the hand gun locked in the slide shield 10, without the necessity of the action locking arm 18 entering the chamber of the pistol which may be occupied by a cartridge.

FIG. 4C shows that upon gripping the handgun's handle and rolling the loop 34 up over the back strap 42 of the handgun grip, the retention loop 34 will collapse forward, releasing its tension from the handgun. At that point, the pistol can be easily withdrawn in a loaded or unloaded condition.

Figure 5:
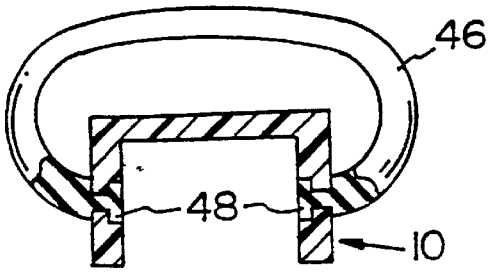
FIG. 5 shows a sectional view of the attachment of the elastic band to the locking assembly.

FIG. 5 shows another type of rubber retention method. A rubber cord 46 has on opposing ends indented nubs 48, which are so dimensioned as to press fit into appropriately positioned holes on either side of the slide shield 10, so as to securely lock within said holes.

Figure 6:
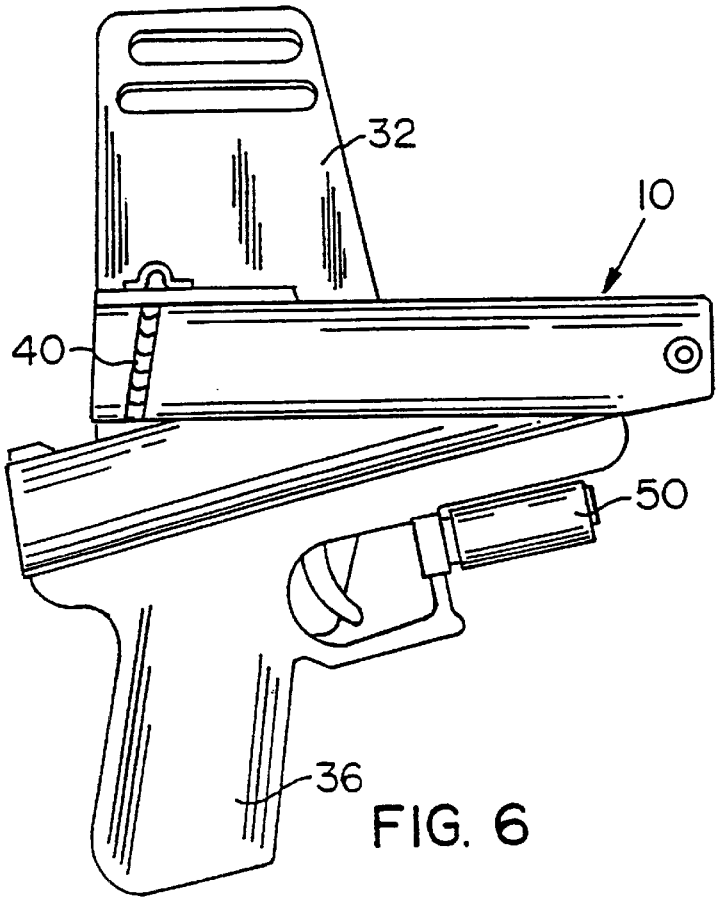
FIG. 6 shows a groove for receiving an elastic band according to the invention.

As shown in FIG. 6, the locking assembly according to the present invention does not interfere with frame-mounted laser devices or high intensity flashlights 50 mounted to the underside of the handgun's frame, forward of the trigger guard. These devices 50 are being increasingly used for proper target acquisition in police and military action. In contrast with the locking assembly according to the present invention, conventional holsters are not appropriately designed to accommodate the various sizes and positions of these devices to the handgun's frame. Placement of a handgun so equipped into an inappropriate holster has often caused the on/off switch to be activated expending the battery life of the devices so that they are inoperative when the handgun is withdrawn.

The locking assembly according to present invention has no contact at any angle of its use with the frame and grip portion of the handgun while it is in its primary unloaded, locked and unlocked position, or in its loaded and cocked position restrained by the action of the rubber retention loop 34.

Figure 7:
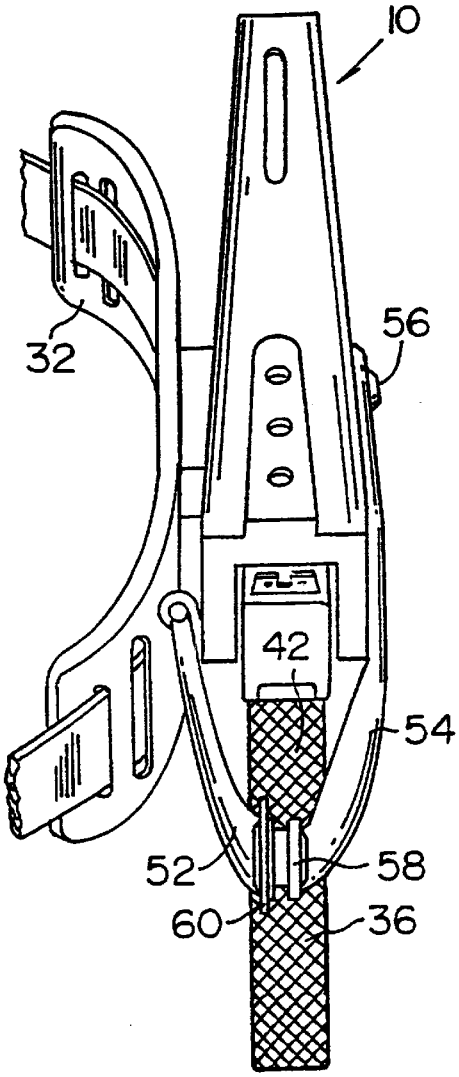
FIG. 7 is a perspective view showing a locking assembly having an elastic band and a body plate according to a further embodiment of the present invention.
Figure 8:
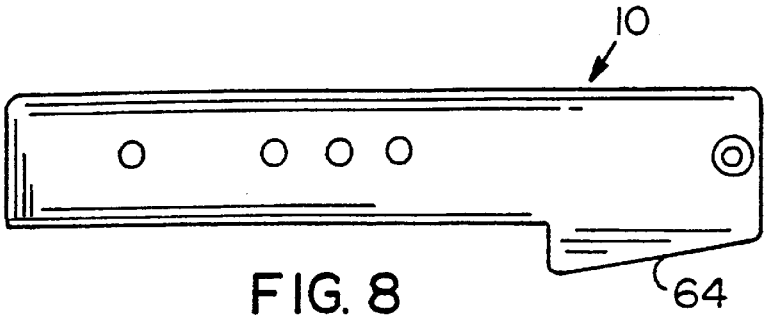
FIG. 8 is a side view showing the locking assembly of FIG. 7.
Figure 9:
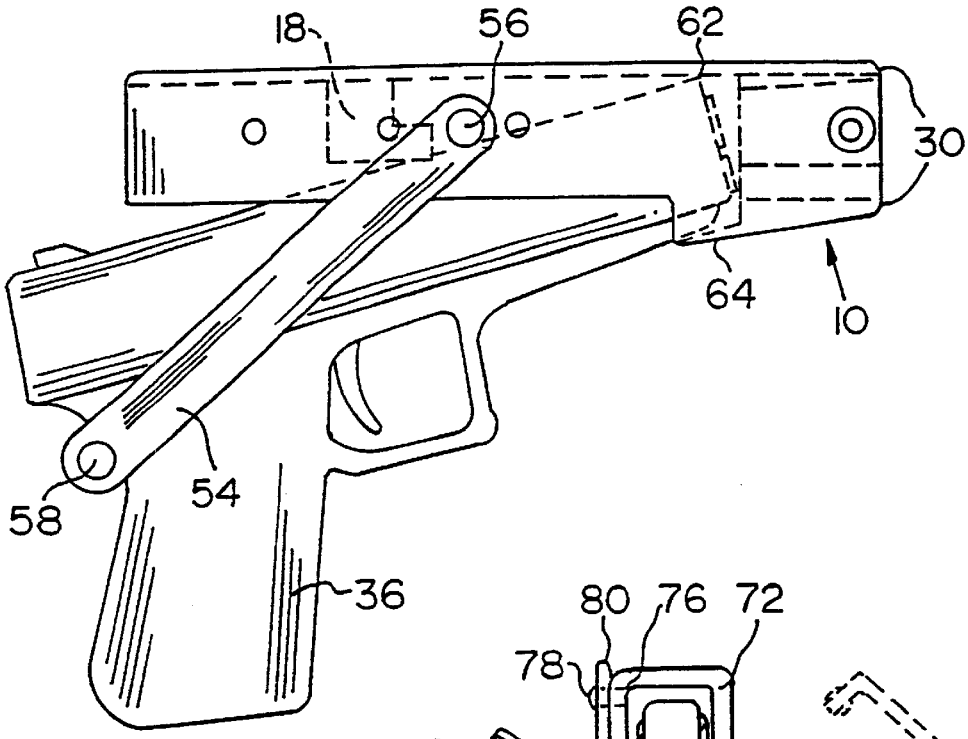
FIG. 9 is a side view showing the embodiment in FIG. 7, excluding the body plate.

FIGS. 7, 8 and 9 show an alternative embodiment of a retention loop according to the present invention. FIG. 7 shows a handgun 36 holstered in a locking assembly including a slide shield 10 and a body plate 32. A first strap 52 consisting of stiff nylon fabric or plastic is attached to the outside of the body plate 32. The length of this first strap 52 is proportioned and designed to be rigidly maintained within the center of the back strap 42 of the handgun's grip. A second strap 54 of like material is affixed to the slide shield 10 by means of, for example, a removable bolt and nut 56. The length of the second strap 54 is proportioned to have it meet at the center of the back strap 42, whereby a corresponding male snap 58 is received in the affixed rigid female snap release 60 on the first strap 52.

The function of these snaps 58 and 60 is to exert a closing pressure at the yoke of the back strap 42, as seen in FIG. 9. This will allow a handgun to be carried within the locking assembly with its chamber closed with either a round in battery or with a closed empty chamber.

The muzzle end 62 of the handgun 36 is contained within the forward portion of the slide shield 10 near the slide block 30. In order to prevent the muzzle end 62 from moving out of the slide shield 10, a configuration of the slide shield 10 is provided having an angulation 64. Angulation 64 shrouds a significant additional portion of the handgun's slide and lower receiver so that pressure is constant when the pistol is in this position.

So locked within the holster, the weapon cannot be withdrawn unless the snaps 58 and 60 on the straps 52 and 54 are released by unsnapping. The action locking arm 18 is in contact with the closed bolt of the chamber. The handgun 36 cannot be rocked out of the holster because of the restraint of the coupled snaps 58 and 60 nor can it be rocked away from the slide and lower receiver containment within the muzzle end of the shield 10.

Figure 10:
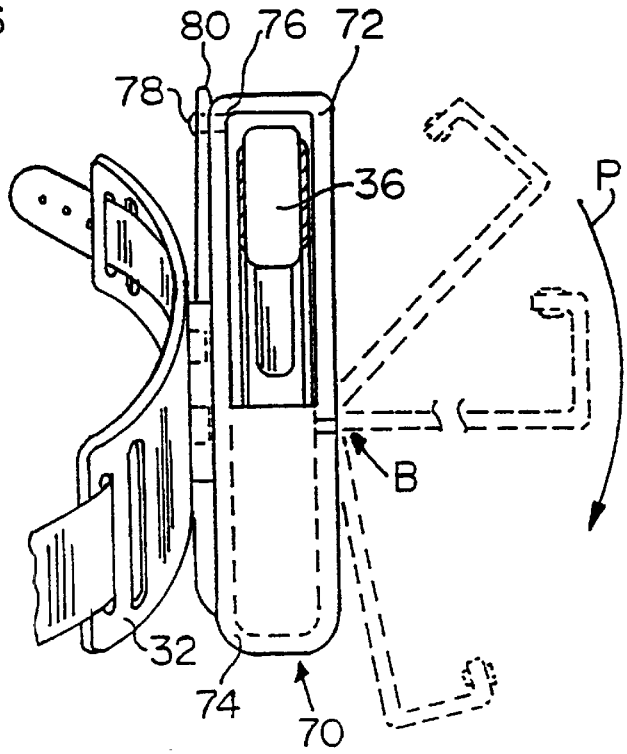
FIG. 10 is a perspective view showing an enclosing holster according to the invention.
Figure 11:
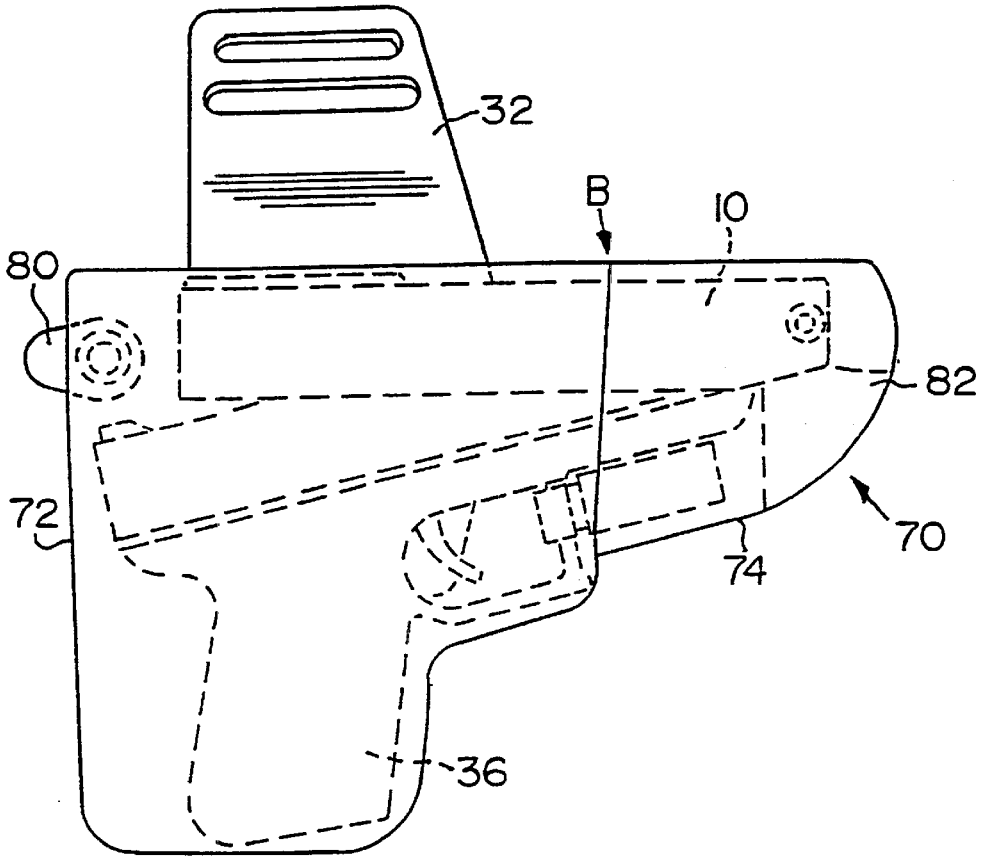
FIG. 11 is a side view of the holster of FIG. 10.

FIGS. 10 and 11 show an enclosing holster 70, which is so fabricated to securely contain within it the slide shield 10 which is securely affixed to the body plate 32. The enclosing holster 70 has a flap 72 which is hinged to the body 74 at flap pivot point B. The flap 72 is closely attached to the body 74 by male snap portion 76. Female snap portion 78 has a thumb release part 80. This release part 80 can be disengaged by a user's thumb to allow the flap 72 to swing outward and down along arrow P, exposing the handgun 36 loaded within the slide shield 10.

In the closed position, the flap 72 secures the trigger guard of the handgun in its loaded and cocked position as shown in FIG. 3, and also protects the handgun from rain, snow, mud, etcetra.

The space 82 between the enclosing holster 70 and the slide shield 10 is provided to accommodate the downward action of the grip of the handgun allowing the muzzle end of the barrel to pass through the slide shield during the loading, cocking and withdrawal of the pistol from the holster.

The enclosing holster 70 is preferably made of leather, zytel, kydex, plastic or nylon.

Figure 12:
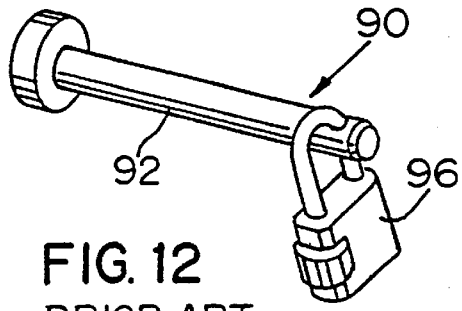
FIG. 12 PRIOR ART
FIG. 12 shows a locking pin as known in the prior art.

FIG. 12 shows a locking pin 90 known in the art. The pin 90 includes a rod 92 which extends through hole 94 in the slide shield 10, shown in FIGS. 1 and 2. A combination lock 96 prevents the pin from being taken out of the slide shield 10. The pin 90 blocks the downward motion of the muzzle end of the barrel, preventing the withdrawal of the handgun.

Figure 13A:
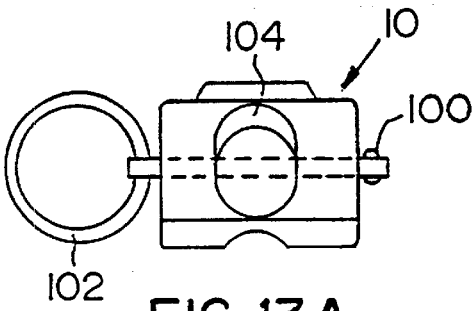
FIGS. 13A and B show a locking pin according to the present invention.
Figure 13B:
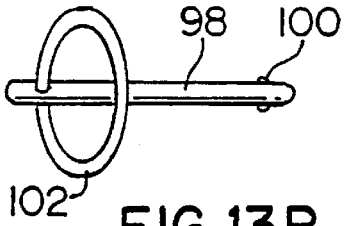

FIGS. 13A and B show an alternative pin 98 designed with a compressible ball bearing 100 at one end to allow the pin to pass through the hole 94 and to retain the pin therein. On the other end of the pin 98, a ring 102 is provided to pull the pin 98 out of the hole 94.

The safety function of pin 98 is to block the downward motion of the muzzle end of the barrel if downward pressure is applied. As the muzzle cannot exit the barrel port 104 of the slide shield 10, the weapon cannot be actioned or withdrawn. The advantage of pin 98 over the locking pin 90 is that a felon cannot snatch the weapon from the rear, but with a single pull, an officer can withdraw his handgun when he wants, loaded and cocked. The ring 102 is so sized to accommodate the index finger of the drawing hand so that the pin can easily be withdrawn with the same hand which subsequently withdraws the pistol from the slide shield 10.

Figure 14:
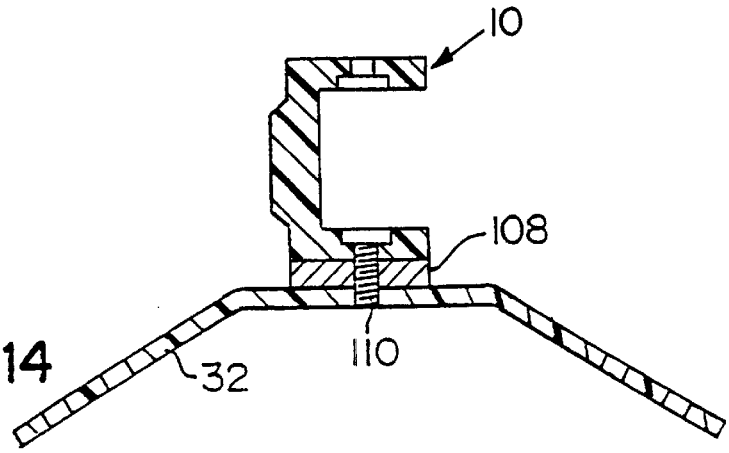
FIG. 14 shows a sectional view of a locking assembly, a body plate and a spacer according to a further embodiment of the present invention.
Figure 15:
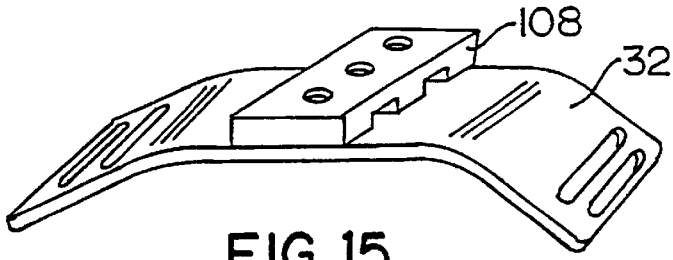
FIG. 15 is a perspective view of the spacer and body plate of FIG. 14.
Figure 16:
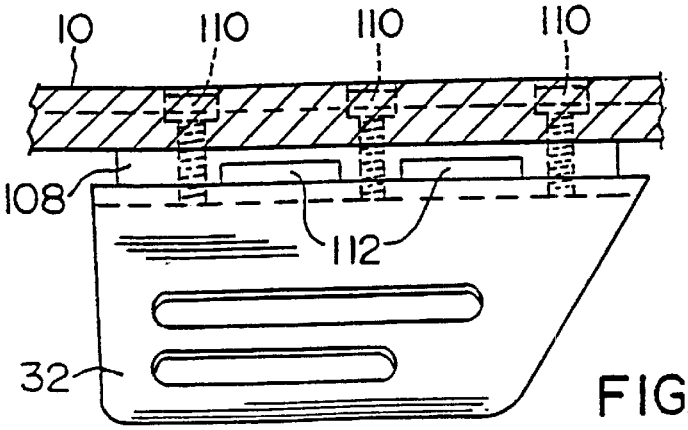
FIG. 16 shows a side view in partial section of the embodiment according to FIG. 14.

FIGS. 14, 15 and 16 show a body plate spacer 108 interposed between the body plate 32 and the slide shield 10. The body plate spacer 108 is attached to the body plate 32 by bolts 110. The slots 112 in the spacer 108 function to accommodate mounting an enclosing holster 70 to the spacer, as described above.

The body plate 32 and spacer 108 can be produced separately, but can also be produced as one monolithic piece, or be molded in high density polymer, or be cast as one piece in aluminum or other metal.

Figure 17:
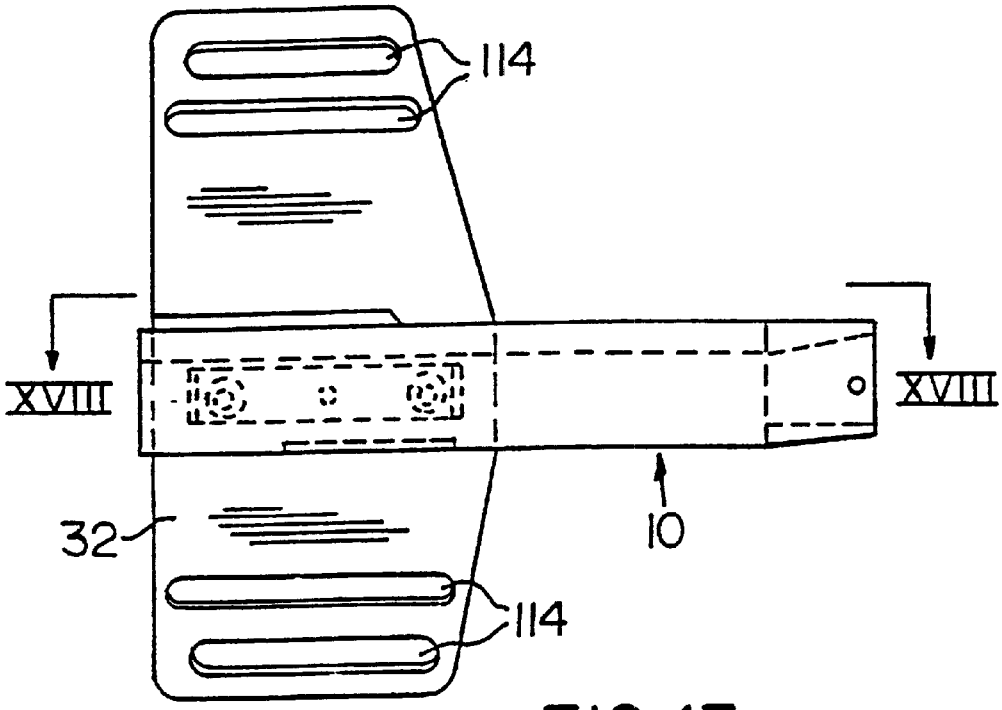
FIG. 17 shows an elevated view of a body plate having added belt slots according to a further embodiment of the present invention.
Figure 18:
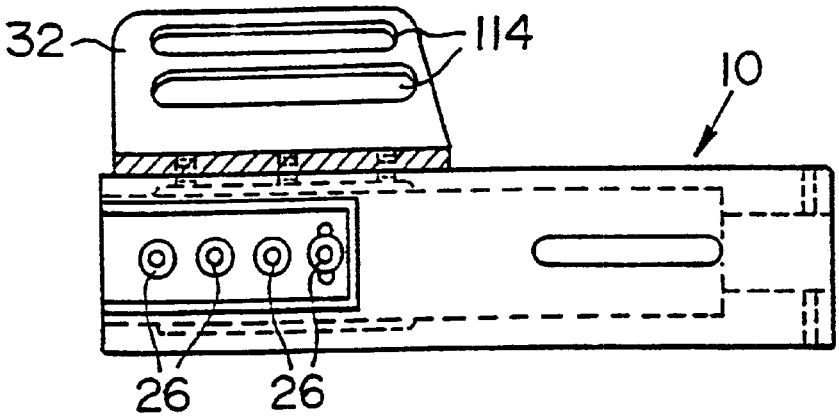
FIG. 18 shows a top view of the embodiment of FIG. 17.

FIGS. 17 and 18 show again the locking assembly according to the present invention. The body plate 32 has belt slots 114 of different sizes to accommodate belts of different widths. The holster can thus be carried in perfect upright position without sliding or rotating relative to the belt.

It will be understood by those of ordinary skill in the art that modifications to the above described preferred embodiments may be made without departing from the spirit and scope of the present invention.

I claim:

1. A locking assembly for a firearm having a firing chamber, a barrel and a spring-loaded, reciprocating slide element, said barrel having a barrel face and a muzzle end, said slide element having a muzzle end, said locking assembly comprising:

a slide shield;

an action locking arm carrying a lug, said lug receivable in the firing chamber and barrel face of said firearm, said action locking arm attached to and positioned within said slide shield;

a slide block attached to said slide shield and spaced from said action locking arm and lug, said slide block having a barrel port for passage of the muzzle end of said barrel therethrough;

the muzzle end of said barrel extendable into said barrel port when the muzzle end of said slide element is placed in contact with said slide block;

whereby when said lug is received in said firing chamber and said barrel face, said muzzle end of said barrel is received in said barrel port and said slide element is in contact with said slide block, said firearm is retained in said locking assembly; and an enclosing holster which receives the slide shield and the firearm, said enclosing holster having a hinged flap with means for securing the flap in a closed position, said flap positioned to swing from the closed position to an open position whereby the firearm and slide shield are exposed.

2. The locking assembly of claim 1 including a thumb release on said flap.

3. The locking assembly of claim 1 wherein said means for securing the flap includes a snap.

4. The locking assembly of claim 1 wherein the enclosing holster and the locking assembly are mounted on a body plate.

5. The locking assembly of claim 4 including a spacer between said locking assembly and said body plate.

* * * * *